United States Patent [19]

Runyan, Jr.

[11] 4,029,330

[45] June 14, 1977

[54] CAMBERED SKATEBOARD PROVIDED WITH LONGITUDINALLY ADJUSTABLE TRUCK ASSEMBLIES

[76] Inventor: Paul S. Runyan, Jr., 6658 Electric Ave., LaJolla, Calif. 92037

[22] Filed: May 5, 1976

[21] Appl. No.: 683,273

[52] U.S. Cl. ..... 280/87.04 A; 280/11.27; 280/87.03

[51] Int. Cl.[2] ..... A63C 17/00

[58] Field of Search ..... 280/87.04 A, 11.28, 280/11.27, 11.26, 11.14, 11.1 BT, 11.1 R, 87.03

[56] References Cited

UNITED STATES PATENTS

| | | | |
|---|---|---|---|
| 1,890,755 | 12/1932 | Shepherd | 280/87.03 |
| 2,098,722 | 11/1937 | DePovsek | 280/11.28 |
| 3,235,282 | 2/1966 | Bostick | 280/11.27 X |
| 3,565,454 | 6/1969 | Stevenson | 280/87.04 A |
| 3,954,279 | 5/1976 | Guerr | 280/11.19 X |
| 3,990,713 | 11/1976 | Hokanson | 280/11.2 X |

FOREIGN PATENTS OR APPLICATIONS

| | | | |
|---|---|---|---|
| 169,739 | 8/1934 | Switzerland | 280/11.1 BT |

*Primary Examiner*—Robert R. Song
*Assistant Examiner*—Milton L. Smith
*Attorney, Agent, or Firm*—Wells, St. John & Roberts

[57] ABSTRACT

A cambered skateboard with a rigid track assembly comforming to curvature of the board at one or both ends. Provision is made for longitudinal adjustment of each truck mounted by the tracks.

9 Claims, 8 Drawing Figures

CAMBERED SKATEBOARD PROVIDED WITH LONGITUDINALLY ADJUSTABLE TRUCK ASSEMBLIES

BACKGROUND OF THE INVENTION

This description relates to skateboards, which are used for coasting along sloped surfaces, the skateboard being steered and controlled by the rider varying his foot placement and position on its upper deck.

Early skateboards were constructed of wood and supported by metal wheel assemblies or trucks similar to those used on roller skates. Recent advances in wheel construction, particularly the development of urethane rollers, permit increased control of the traction and maneuverability of the skateboard. These new rollers assure accurate tracking without slippage, and have eliminated the noise previously associated with use of this hobby item. In addition, many skateboards are now produced of glass fiber reinforced resin laminates and other lightweight materials which provide added strength and resiliency. A substantial hobby cult has developed around the skateboard. Both amateur and professional users have developed a repertory of highly difficult maneuvers and contests, such as slalom and downhill races, and acrobatic or "hot dog" demonstrations and contests. This has led to a demand for skateboards having increased opportunities for control by the user and more accurate adjustment features to meet the particular requirements of both the user and the type of performance desired.

U.S. Pat. No. 3,235,282, granted to Bostick on Feb. 15, 1966, shows a flat rigid skateboard with longitudinally adjustable wheel carriages. No mention is made of the possibility of the board being flexible or cambered.

Prior skateboards have been cambered, but the degree of camber is controlled solely by the resiliency of the board structure itself and no reinforcement of the camber is provided at the under surface of the skateboard. Normally the central portion of the skateboard between the front and rear truck assemblies is arched upwardly. The nose and tail portion of the board are sometimes curved upwardly or downwardly, depending on the particular application for which the board is designed.

According to the present invention, longitudinally adjustable trucks are provided at one or both ends of a resilient board having a central longitudinal camber. The tracks that adjustably mount the trucks have longitudinal surfaces in engagement with the lower surface of the board. These longitudinal surfaces are complementary to the surface configuration or camber of the skateboard surface to which they are fixed. The tracks, being rigid, reinforce the camber of the board in addition to providing a plane support for the movable truck assemblies. Longitudinal adjustment of a truck therefore varies the camber characteristics of the board as well as the wheel base length. In addition, by narrowing the board at one end over a truck, torsional flexibility can be provided to further modify the turning characteristics of a particular board.

SUMMARY OF THE INVENTION

This improvement in a skateboard structure relates to mounting of one or both trucks to permit longitudinal adjustments of the trucks and to reinforce the camber of a resilient board. The mounting comprises a rigid track having an upper longitudinal surface shaped complementary to the unweighted configuration of a cambered portion of the lower surface of the board. The track is fixed to the cambered portion for surface-to-surface engagement to reinforce the cambered configuration. The trucks are releasably mounted to the track to selectively vary the longitudinal separation of the trucks.

Two embodiments of the invention are illustrated. In one, both the front and rear of the board have an upwardly curving camber and both the front and rear truck assemblies are mounted by the improved tracks. In the second embodiment, only the front truck is longitudinally adjustable and the camber is reinforced only at the front end of the board. The illustrated camber at the nose of this second board curves downwardly. The nose portion of the board along the tracks is substantially more narrow in width than the main width of the board, imparting torsional resiliency to the operation characteristics of the board.

It is a first object of this invention to provide a mechanically simple method of reinforcing the camber along a skateboard and providing longitudinal adjustment of the supporting assemblies.

Another object of this invention is to provide a skateboard that can be readily adjusted and adapted for a variety of different applications and to meet the weight and performance requirements of particular users.

These and further objects will become evident from the following disclosure, taken together with the accompanying drawings.

DESCRIPTION OF PREFERRED EMBODIMENTS

Figure 1:
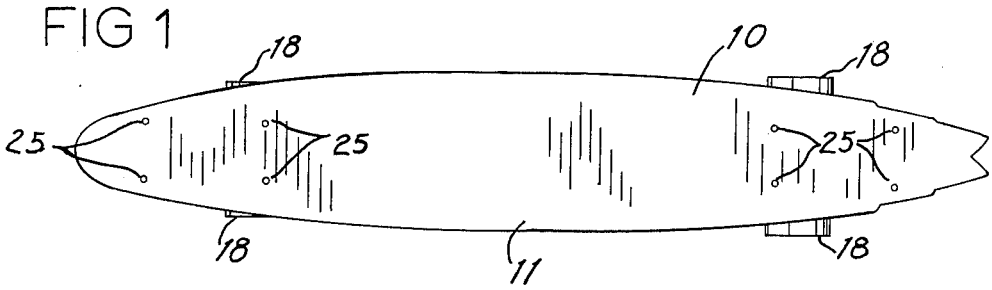
FIG. 1 is a top view of the first embodiment of the skateboard.

The skateboards illustrated in the drawings show two embodiments illustrating use of the present improvements. FIGS. 1 through 4 illustrate a skateboard having a double camber, with both the nose and tail portions of the board curved upwardly. Longitudinally adjustable truck assemblies are mounted at both ends of this unit. FIGS. 5 through 8 illustrate a second embodiment in which the rear truck assembly is stationary and the nose of the board is curved downwardly. Only the front truck assembly is longitudinally adjustable. In addition, the board itself is designed to provide torsional resiliency to modify the steering characteristics of the skateboard.

In most instances, identical or corresponding reference numerals are used in the drawings to specify the components of both embodiments of the skateboard. In the interest of brevity, common components will be described with respect to the first embodiment, it being understood that the description is equally applicable to the details of the second embodiment. The skateboards will be referred to with reference to their normal position on a supporting surface, the "deck" or upper surface of the skateboards being directed upwardly. References to the front or forward direction shall designate the usual direction of travel of the user of the board.

Referring now to FIGS. 1–4 and the first embodiment of the invention, the board 10 has a longitudinally elongated shape tapering at both its front and rear ends to present nose and tail portions, respectively. The board 10 can be constructed of any suitable resilient material capable of deflecting under the weight and pressure of a user. The particular skateboard configuration should be designed to limit the amount of flexing of the board during use so as to assure adequate clearance of the ground or supporting surface. The board 10 is typically constructed of fiber-reinforced plastic resin, with laminated layers of glass fibers embedded in a plastic matrix. It might also include a foam core or other suitable structural reinforcement. The board 10 has an upwardly facing deck surface 11 and an oppositely facing lower surface 12. The lower surface 12 is substantially parallel to the deck surface 11, since the board normally is constructed with a common thickness along its length. However, the thickness of the board 10 might be varied along its length to modify the degree of flexibility desired in a particular unit.

The trucks 13 are conventional. Similar or equivalent trucks can be substituted in the illustrated structure. Each truck 13 comprises a supporting base having two bosses 15, 16 protruding downwardly in the form of receiving sockets. Transverse axles 17 for the rollers 18 are supported by a strut 20 movably mounted in boss 15. Its outboard end is resiliently engaged by two rubber collars 21 on a movable support bolt received in boss 15. The trucks 13 permit tilting and pivoting of axle 17 and rollers 18 relative to the connection of strut 20 in boss 15 so that the axle 17 has limited freedom to tilt and twist for turning purposes. The details of trucks 13 do not form a part of the present invention.

The board 10 shown in FIGS. 1 through 4 has a double camber, being curved upwardly at its center and at both longitudinal ends. The camber in the board, which is pre-formed during its fabrication, is reinforced by tracks that mount the front and rear trucks 13. Each track comprises two rigid longitudinal rails 22 which are fixed to the lower surface of the board 12 by mounting rivets 25 or other suitable connectors. The rails 22 are mounted side by side and are spaced transversely in parallel positions. Each rail 22 has a longitudinally curved upper surface 23 and an oppositely facing planar surface 24. The lower surfaces 24 of rails 22 have a series of longitudinally spaced apertures 29, which are threaded to collectively receive cap screws 26 that secure the base 14 of each truck to the rails 22.

Figure 2:
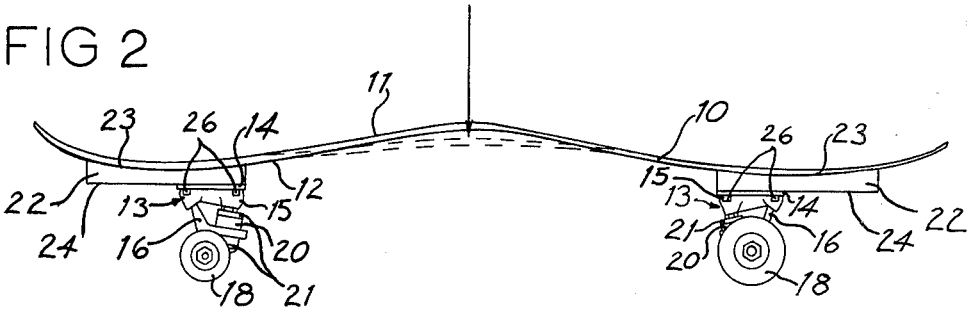
FIG. 2 is a side elevational view showing a first position of the truck assemblies.
Figure 3:
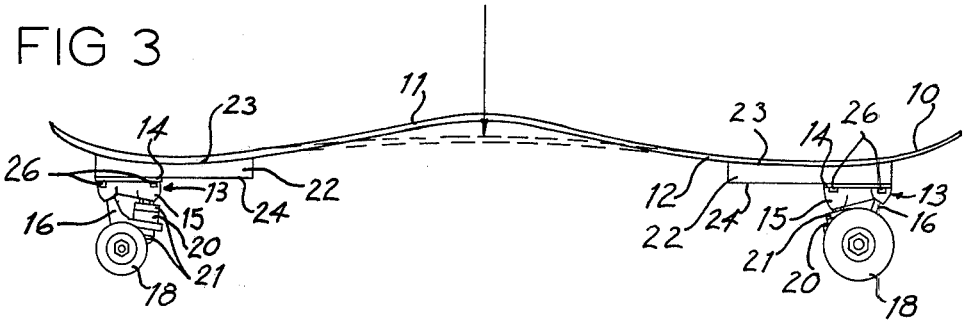
FIG. 3 is a side elevational view showing a second position of the truck assemblies.
Figure 4:
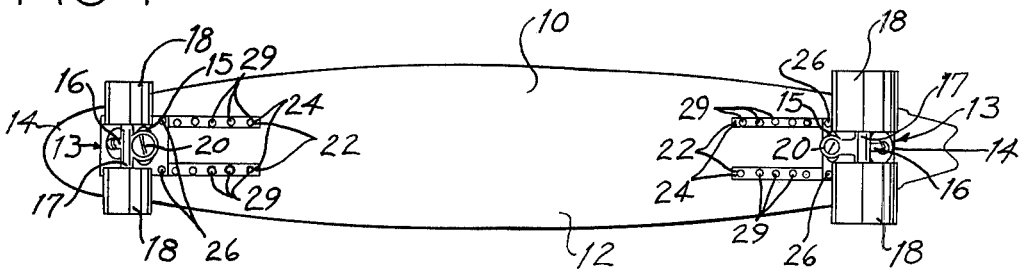
FIG. 4 is a bottom view of the skateboard as shown in FIG. 3.
Figure 5:
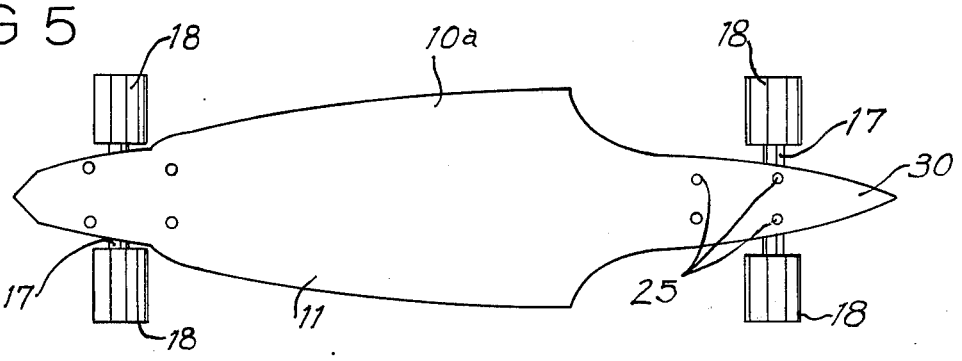
FIG. 5 is a top view of a second embodiment of the skateboard.
Figure 6:
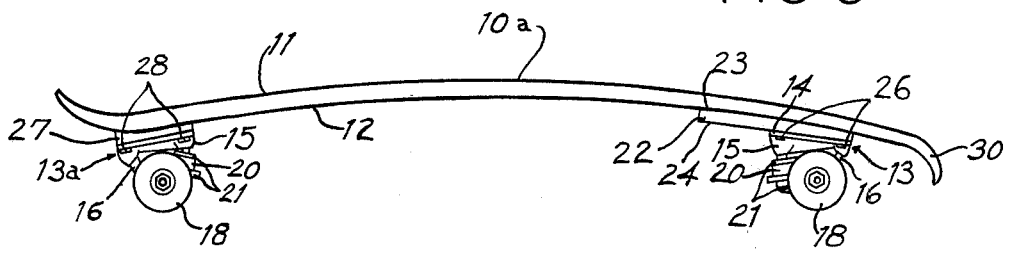
FIG. 6 is a side view of the skateboard shown in FIG. 5.
Figure 7:
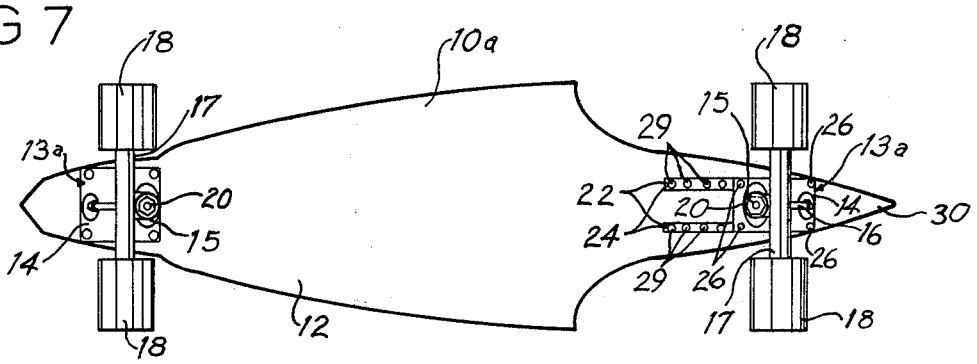
FIG. 7 is a bottom view of the skateboard shown in FIG. 5.
Figure 8:
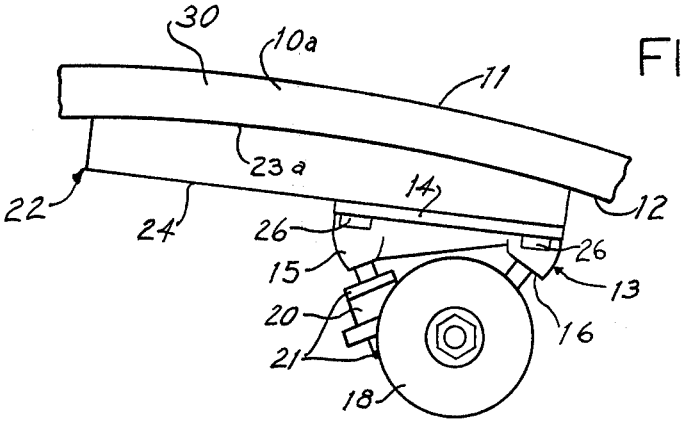
FIG. 8 is an enlarged side view of the front portion of the skateboard in FIG. 5.

FIGS. 2 and 3 represent extreme positions of the trucks 13. FIG. 2 illustrates trucks 13 being located along rail 22 at positions nearest to the center of board 10. This provides equally balanced board configuration with a minimum wheel base. FIG. 3 illustrates the trucks spaced at a maximum, providing the maximum wheel base under board 10.

The rigid rails 22 reinforce the curvature or camber of the portions of board 10 engaged thereby. In FIGS. 1–4, each rail 22 has a longitudinally concave upper surface 23 which is complementary to the configuration of that portion of board 10 engaged by the rails 22 in surface-to-surface contact engagement. This surface-to-surface contact rigidifies the engaged portion of board 10 and helps to maintain the camber or curvature along the skateboard. This is particularly helpful at the nose and tail of the board, which would otherwise have more of a tendency to flex under the weight of one's foot when extended forwardly or rearwardly to tip the board.

Besides adjusting the length of the wheel base and corresponding turning characteristics of the skateboard, the relative positions of the trucks 13 along rail 22 modifies the stiffness of the central portion of the board 10. As can be seen in FIGS. 2 and 3, the close spacing of trucks 13 in FIG. 2 would make the central portion of the board more stiff and result in less downward flexion as indicated in dashed lines. In FIG. 3 the amount of deflection for the same downward force (indicated by a vertical arrow in FIG. 2 and 3) would be correspondingly greater.

The longitudinal adjustment of the trucks 13 permits the skateboard to be adjusted for different types of performances. Shorter wheelbases are desirable for acrobatic or "hot dog" usage. Intermediate lengths of wheelbases are desirable for slalom and giant slalom usage and the longest wheelbases are desirable for downhill racing. This board enables a rider to have all these wheelbase parameters available in one skateboard.

FIGS. 5 through 8 show a second embodiment of the skateboard. The skateboard **10*a* has a narrow front tongue 30 along an adjustment track for a front truck 13. The track is basically identical to that previously discussed, with the exception that the upper surface 23*a* of the rails 22 are longitudinally convex to complement the downturned nose at the front end of the cambered board 10*a*.**

In this second embodiment, the rear end of the skateboard is supported by a stationary truck **12*a* fixed permanently to the board 10*a*. It is secured to board 10*a* by mounting rivets or other connectors 28, with an interposed pad 27 for resilient conformation to the lower surface of board 10*a*.**

In this second embodiment, the rails 22 reinforce the camber of the portion of board **10*a* engaged by them and provide means for longitudinal adjustment of truck 13** in the general manner described above.

In addition, the narrow tongue 30 along the length of rails 22 permits torsional bending or twisting of the board to a greater degree at the front of the board **10*a* than at its rear end. This allows the rollers 18 at the front of the skateboard to assume a different axle angle than the rollers at its rear end. This allows one to modify the turning characteristics of the board and permits the board to accommodate longitudinal twisting forces that might be encountered due to surface variations while coasting. This second embodiment is designed basically for slalom racing and the resilience of board 10*a* must be designed for greater flexibility than normally desired in a skateboard. The ability of the board to twist along its length enables a racer to snake through slalom gates and to execute controlled power slides, as well as to brake the skateboard by weighting the chassis at proper times. All longitudinal adjustments of the wheelbase are accomplished by movement of the front truck 13** only.

As is evident from these two embodiments, either one or both trucks at opposite ends of a skateboard can be longitudinally adjustable. The board camber can be reinforced at either or both ends by use of this structure. In addition, the track for mounting the trucks can be used to reinforce camber of the board whether it is turned downwardly or upwardly at either end.

Minor modifications might be made in the structure without deviating from the basic structural relationship discussed above. For this reason only the following claims are intended as limits of the invention described herein.

Having thus described my invention, I claim:

1. In a skateboard having a longitudinally cambered board made from resilient material capable of limited flexing under the weight of a rider, the skateboard having substantially parallel deck and lower surfaces, and front and back longitudinally spaced trucks mounted to its lower surface for carrying a rider along a path selected by application of pressure to the deck surface; the improvement comprising:

first mounting means for permitting longitudinal adjustment of one of the trucks with respect to the board, said first mounting means including:

a rigid track assembly having an upper longitudinal surface complementary to the unweighted configuration of a cambered portion of the lower surface of the board, said track assembly being fixed to said cambered portion in surface-to-surface engagement between the upper surface of the track and the lower surface of the board; and releasable means operably engaged between said one truck and said track assembly for selectively fixing the longitudinal position of the truck relative to the track assembly.

2. A skateboard as set out in claim 1 wherein the cambered portion of the board immediately above said track is substantially more narrow in transverse width than the transverse width of the board along its length between the longitudinally spaced trucks.

3. A skateboard as set out in claim 2 wherein the remaining truck is mounted at a stationary position with respect to the board.

4. A skateboard as set out in claim 1 wherein said track assembly and said one truck are located adjacent the front or nose of the board and wherein the cambered portion of the board immediately above said track assembly is in the form of an elongated narrow tongue having a width substantially less than the transverse width of the board along its length between the longitudinally spaced trucks, there being an abrupt increase in the board width immediately rearward of said track assembly.

5. A skateboard as set out in claim 1 further comprising:

second mounting means spaced longitudinally from said first mounting means for permitting longitudinal adjustment of a second truck with respect to the board, said second mounting means including:

a rigid track assembly having an upper longitudinal surface complementary to the unweighted configuration of a cambered portion of the lower surface of the board, said track assembly being affixed to said cambered portion in surface-to-surface engagement between the upper surface of the track assembly and the lower surface of the board;

releasable means operably engaged between the second truck and said last-named track assembly for selectively fixing the longitudinal position of the second truck relative to said last-named track assembly.

6. A skateboard set out in claim 1 wherein the upper longitudinal surface of the track has a concave longitudinal curvature.

7. A skateboard as set out in claim 1 wherein the upper longitudinal surface of the track has a convex longitudinal curvature.

8. A skateboard as set out in claim 1 wherein the track comprises a pair of transversely spaced rails identical to one another and fixed to the board in a parallel side-by-side relationship to one another.

9. A skateboard as set out in claim 1 wherein the track comprises a pair of transversely spaced rails identical to one another and fixed to the board in a parallel side-by-side relationship to one another;

the lower surface of each rail being planar;

said truck having an upwardly facing flat mounting surface complementary to the planar lower surfaces of the rails for surface-to-surface engagement therewith;

said releasable means being connected between the truck and the respective rails to maintain the mounting surface of the truck in a fixed position engaged against the lower surface of each rail.

* * * * *